US008000887B2

(12) United States Patent
Nathan et al.

(10) Patent No.: US 8,000,887 B2
(45) Date of Patent: Aug. 16, 2011

(54) METHOD AND SYSTEM OF DIRECTING VEHICLES TRAVELING OVER ROADWAY DURING EMERGENCY

(75) Inventors: John F. Nathan, White Lake, MI (US); H. Winston Maue, Northville, MI (US)

(73) Assignee: Lear Corporation, Southfield, MI (US)

( * ) Notice: Subject to any disclaimer, the term of this patent is extended or adjusted under 35 U.S.C. 154(b) by 1217 days.

(21) Appl. No.: 11/675,194

(22) Filed: Feb. 15, 2007

(65) Prior Publication Data

US 2007/0198168 A1 Aug. 23, 2007

Related U.S. Application Data

(60) Provisional application No. 60/774,733, filed on Feb. 17, 2006.

(51) Int. Cl.
*G08G 1/00* (2006.01)

(52) U.S. Cl. ..... 701/117

(58) Field of Classification Search ..... 701/117
See application file for complete search history.

(56) References Cited

U.S. PATENT DOCUMENTS

| | | | | |
|---|---|---|---|---|
| 6,255,956 | B1 | 7/2001 | Tingley et al. | |
| 6,278,358 | B1 | 8/2001 | Spoto et al. | |
| 6,278,377 | B1 | 8/2001 | DeLine et al. | |
| 6,437,687 | B2 | 8/2002 | Spencer | |
| 6,575,902 | B1 | 6/2003 | Burton | |
| 7,349,768 | B2 * | 3/2008 | Bruce et al. | 701/1 |
| 2004/0044293 | A1 | 3/2004 | Burton | |
| 2004/0104590 | A1 | 6/2004 | Kikuchi et al. | |
| 2005/0012606 | A1 | 1/2005 | Lee | |
| 2005/0041819 | A1 | 2/2005 | Brown | |
| 2005/0057372 | A1 * | 3/2005 | Taylor | 340/901 |
| 2005/0267651 | A1 * | 12/2005 | Arango et al. | 701/3 |
| 2006/0241856 | A1 * | 10/2006 | Cobleigh et al. | 701/202 |
| 2007/0192025 | A1 * | 8/2007 | Iwahori | 701/208 |
| 2007/0198168 | A1 * | 8/2007 | Nathan et al. | 701/117 |
| 2008/0004790 | A1 * | 1/2008 | Ames | 701/117 |
| 2008/0046134 | A1 * | 2/2008 | Bruce et al. | 701/1 |
| 2009/0030603 | A1 * | 1/2009 | Madalin et al. | 701/202 |

* cited by examiner

*Primary Examiner* — John Q Nguyen
*Assistant Examiner* — Brian J Broadhead
(74) *Attorney, Agent, or Firm* — Brooks Kushman P.C.

(57) ABSTRACT

A method of directing and/or alert vehicles during an emergency or other event. The method may include providing messages and other information to the vehicles through wireless communications. The message may detail the emergency and/or an evacuation strategy for avoiding the emergency. Different vehicles may receive different messages and instructions depending on vehicle location and other parameters.

16 Claims, 1 Drawing Sheet

METHOD AND SYSTEM OF DIRECTING VEHICLES TRAVELING OVER ROADWAY DURING EMERGENCY

CROSS-REFERENCE TO RELATED APPLICATIONS

This application claims the benefit of U.S. provisional application Ser. No. 60/774,733, filed Feb. 17, 2006, the disclosure of which is hereby incorporated in its entirety.

BACKGROUND OF THE INVENTION

1. Field of the Invention

The present invention relates to directing vehicles traveling over a roadway during an emergency, such as but not limited to evacuating the vehicles from a cite of a natural or unnatural disaster.

2. Background Art

Any number of natural and unnatural events may require a community or geographical location to move a high quantity of people from a dangerous areas to a safer area. The process may be implemented, at least in part, through vehicular roadway based travel where persons evacuate the scene through mass vehicle transport. The resulting sudden increase in traffic tends to provide gridlock and excessively slow roadway transport. This can be problematic when trying to evacuate an area.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION OF THE PREFERRED EMBODIMENT(S)

Figure 1:
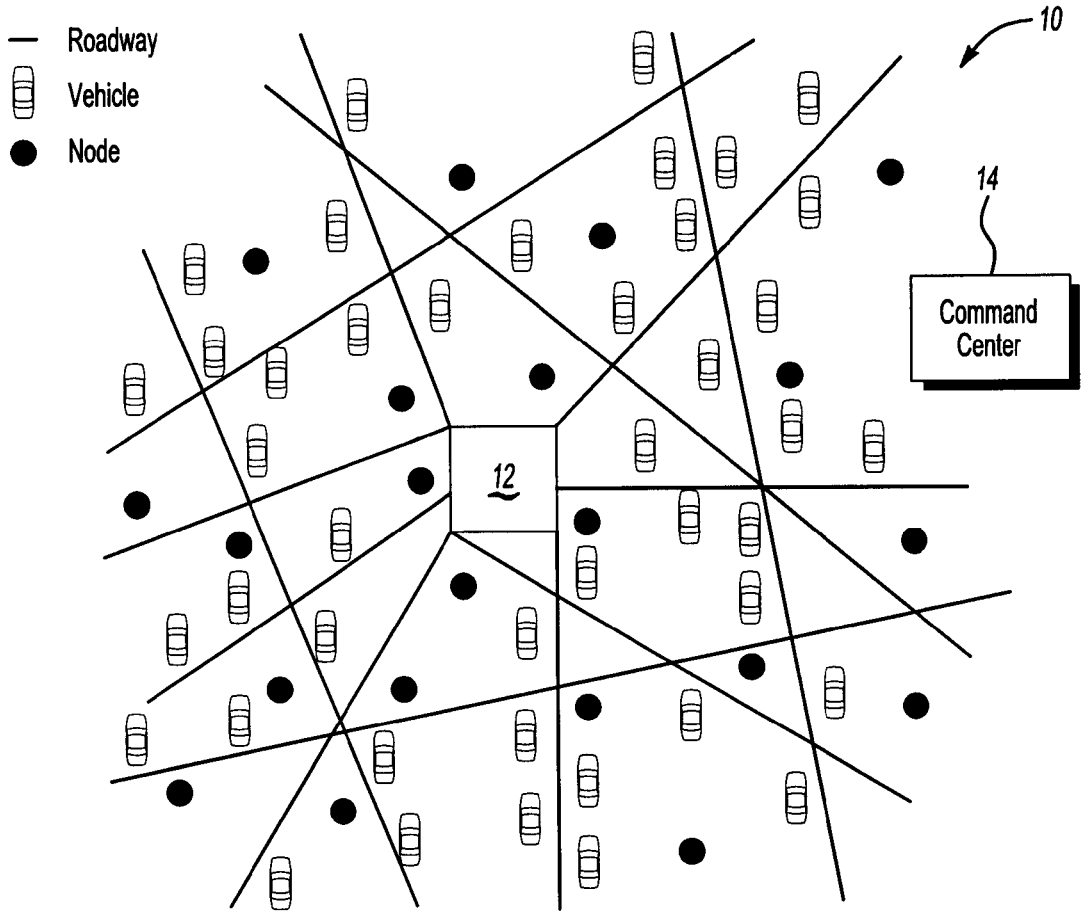
FIG. 1 illustrates an roadway evacuation system in accordance with one non-limiting aspect of the present invention.

FIG. 1 illustrates an roadway evacuation system 10 in accordance with one non-limiting aspect of the present invention. The system 10 may include a number of roadways defined relative to a city center 12. The roadways may be single or multi-lane roadways constructed to facilitate vehicular travel with respect to the city center and its surrounding areas (suburbs), as is commonly employed to facilitate movements in metropolitan areas.

The system 10 may be used to facilitate roadway based evacuations during a natural or unnatural disasters. The system 10 may facilitate instructing vehicles with respect to the disaster and a course of action to evacuate the area. One goal of the system is to limit congestion and gridlock during the evacuation by instructing different vehicles to take different routes out of the influenced area so as to maximize available roadway usage.

The system 10 may include a number of stationary or land nodes positioned around the geographical area of interest. The nodes may be part of electronically controllable street signs or other displays and/or standalone items dedicated to supporting wireless communication or other communication needs of the present invention. The nodes are shown and predominately described with respect to being land based nodes, however, the present invention is not intended to be so limited and fully contemplates the nodes being satellite or other non-land based nodes.

A portion of the nodes may be positioned relative to a different roadways to monitor traffic levels. The nodes may determine any number of traffic related characteristics as a function of traffic monitoring sensors and/or information communicated thereto from the vehicles. The nodes may form a mesh or other network for sharing traffic related information and/or one or more of the nodes may be a command center node 14 tasked with assembling and/or processing traffic data from the other nodes.

One or more vehicles traveling over the roadways or otherwise within the vicinity of the land nodes may include capabilities for wirelessly communicating with the land nodes. Vehicles having such wireless capabilities may be considered as mobile nodes. The mobile nodes may collect data from the vehicles for communication to the other nodes and subsequent use in developing an evacuation strategy. The mobile nodes may form a mesh network or other network with the land nodes and/or other vehicles such that various information may be shared between the same.

Communication between the land and mobile nodes may be advantageous in rapidly spreading data and other signals through a disaster area. The communication may be used to no only assess the location of vehicles, but the vehicle operating capabilities and quantities and identities of individuals likely to be in the area. This and other information may be helpful in assessing the scope of the disaster and whether the vehicles can be used to facilitate the evacuation. The location of the vehicles can be critical to assessing routes and methods for facilitating the evacuation.

The nodes may be configured and programmed to support any number of operations as contemplated and required by the present invention. This may include some form of wireless communication capability that allows new nodes and vehicles to be freely added and removed from the network, such as to facilitate instigating and terminating communication with vehicles traveling into and leaving the geographical area of interest.

Figure 2:
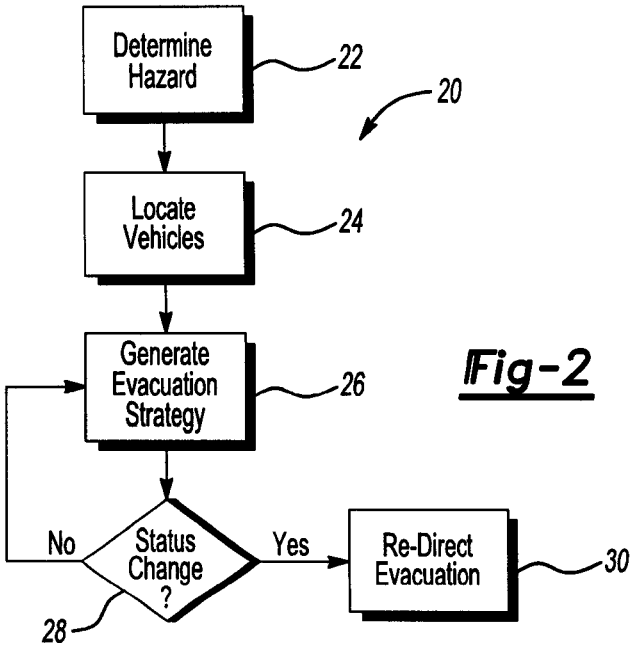
FIG. 2 illustrates a flowchart of a method of alerting vehicles in accordance with one non-limiting aspect of the present invention.

The communication between the nodes and the vehicles may be used to assess any number of travel and non-travel related conditions for facilitating the evacuation, including the following: real time traffic volume monitoring (monitoring volume of moving nodes per stationary node, volume of nodes in relation to each other (node densities), speed of moving nodes passing, any emergency event ID of nodes); real time detection of traffic volumes, problems or concerns; control/detection/and reroute solutions real time for emergency entities for volume concerns during emergency evacuations procedures; providing emergency entity with priority ID and privilege during node travel; controlling visual signage for indicating potential dangers for moving nodes FIG. 2 illustrates a flowchart 20 of a method of alerting vehicles in accordance with one non-limiting aspect of the present invention. The method generally relates to determining a hazard and communicating with the vehicles in response thereto. The method may be totally or partially executed according to instructions included within a computer-readable or other logically executable system included in any of the nodes identified above.

Block 22 relates to determining a hazard. The hazard may be determined by one of the nodes and/or a response entity. The hazard determination may include determining the scope of the hazard, its location, area of influence, and any number of other characteristics which may be helpful in facilitating evacuation of the influenced areas. A warning regarding the hazard and information related thereto may be transmitted to the other nodes through node-to-node (including vehicle-to-vehicle) or other wireless and/or wireline communication methodologies so that information related to the node can be rapidly spread.

Block 24 relates to locating vehicles which may need to be evacuated in response to the hazard. Each of the land nodes may be awoken and requested to scan for vehicles within its corresponding area. Some of the nodes may scan within an area associated with the other nodes in case one or more of the other nodes are lost or otherwise unavailable, thereby providing redundancy and self-healing of the mesh network. The located vehicles may be identified and analyzed, such as for operability, number of possible passengers, etc.

Block 26 relates to determining an evacuation strategy. The evacuation strategy generally corresponds with instructing the located vehicles with respect to fleeing from the area(s) of danger resulting from the hazard. This may include analysis of the hazard and various pieces of vehicle information, such as vehicle location, vehicle density, roadway capabilities, etc. The information from the nodes may be fed back to a command center for use by emergency response personnel in developing the evacuation strategy. The nodes may be configured to automatically provide an evacuation strategy that may then be checked or updated by the command center.

Once the evacuation strategy is determined, instructions may be provided to the vehicles through the mesh network. This may include communication between the land nodes and the vehicle nodes and/or vehicle-to-vehicle communications. The instructions may operate with displays and/or other capabilities to the vehicles to facilitate communicating the evacuation strategy and roadway directions to the vehicle operators. The instructions may integrate with vehicle system, such as GPS systems, and/or with dedicated devices, such as a tamper resistant emergency devices included on the vehicles.

Different vehicles may receive different evacuation strategies depending on any number of variables. One vehicle in a particular area may be instructed to evacuate along one roadway while a nearby vehicle may instructed to evacuating along another roadway so as to avoid congestion. In some cases, the vehicles may be instructed to take action in contradiction to roadside signage, such as evacuating the area against the posted direction of travel, which may be helpful to convert both incoming and outgoing lanes of traffic for outgoing evacuation.

Block 28 relates to determining changes in the evacuation strategy. The changes may occur on a micro and/or macro level. The micro level may correspond with individual or small group changes in direction based on changes in vehicle congestion or hazard spread. The macro level may correspond with global changes, such as re-routing a large number of vehicles due to loss of a roadway or change in the hazard. This allows the present invention to redirect one or more vehicles or large number of vehicles. Optionally, the nodes closest to the vehicles may constantly assess traffic flow and other evacuation parameters and re-reroute or otherwise re-direct traffic as it deems necessary.

Block 30 relates to implementing the changes noted above. This may include communicating the changes to the re-routed vehicles and the nodes supporting the same. Like the original evacuation strategy, the re-routing and re-directing may be continuously monitored and adapted according to any number of operating conditions and parameters.

The present invention, as described above, may be used to direct traffic and facilitate evacuation in response to any number of dangers or hazards. One non-limiting aspect of the present invention may relate to generating an emergency broadcast in response to one or more alarms determining occurrence of the emergency and thereafter automatically communicating the emergency broadcast to one or more vehicles through vehicle-to-vehicle communications to alert the vehicles of the emergency. The broadcast may include an evacuation strategy and/or it may simply alert the vehicles to the danger. Optionally, the emergency may be determined as a function of one or more alarms included within one or more buildings and limiting the emergency broadcast to vehicles traveling towards or near an area influenced by the building emergency.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of directing vehicles traveling over roadways during an emergency, the method comprising:

electronically processing signals communicated from the vehicles to determine a location for each vehicle communicating signals;

determining an evacuation route for the vehicles as a function of vehicle location, the evacuation route suitable for routing traffic away from the emergency;

electronically communicating evacuation information representative of the evacuation route to the vehicles for use in evacuating the vehicles, each vehicle receiving the evacuation information outputting an evacuation message to vehicle drivers; and wherein the evacuation message instructs the vehicle drivers to take action in contradiction to permissible action specified in roadside signage.

2. The method of claim 1 further comprising customizing the evacuation route for different vehicles depending on vehicle location and roadway availability.

3. The method of claim 1 further comprising adjusting the evacuation route for one or more of the vehicles as a function of changes in the emergency determined after initially communication the evacuation route.

4. The method of claim 1 further comprising adjusting the evacuation route for one or more of the vehicles as a function of movement of the vehicles determined after initially communicating the evacuation route.

5. The method of claim 1 further comprising adjusting the evacuation route for one or more of the vehicles as a function of instructions received from an emergency response entity after initially communication the evacuation route.

6. The method of claim 1 further comprising communicating the evacuation route to the vehicles through vehicle-to-vehicle communications.

7. The method of claim 1 further comprising the instructing the drivers to travel in a wrong direction such that the drivers take action in contradiction to a permissible direction of travel specified in roadside signage.

8. The method of claim 1 further comprising locating the vehicles as a function of global positioning system (GPS) data being communicated from the vehicles to a traffic management entity used to generate the evacuation route.

9. The method of claim 8 further comprising the traffic management entity analyzing traffic flow information and developing the evacuation route as a function thereof.

10. The method of claim 8 further comprising displaying the evacuation route on GPS units included on the vehicles to facilitate evacuating the vehicles.

11. The method of claim 1 further comprising providing different instructions evacuation information to different vehicles depending on vehicle location and direction of travel.

12. A method of directing vehicles, the method comprising:

establishing a mesh network between the vehicles and a number of land nodes;

in response to determining an emergency, communicating an emergency alert message to the vehicles over the mesh network;

providing evacuation instructions to the vehicles after communicating the emergency alert message, the evacuation instructions being determined at least in part by an emergency response entity and the emergency alert message being determined automatically as a function of signals received from one or more emergency alert alarms;

each vehicle receiving the emergency alert message generating an emergency indicator to alert vehicle occupants to the emergency;

each vehicle receiving the evacuation instructions and traveling towards the emergency outputting an evacuation message specified in the evacuation instructions to instruct the vehicle occupants of an evacuation route; and each vehicle receiving the evacuation instructions and traveling away from the emergency ignoring the evacuation instructions.

13. The method of claim 12 further comprising including a vehicle location specific evacuation strategy within the emergency alert message to facilitate evacuating vehicle away from the emergency.

14. The method of claim 12 further comprising including a description of the emergency within the emergency alert message for alerting vehicle occupants of the emergency.

15. The method of claim 12 further comprising including instructions in the evacuation instructions for commanding vehicle drivers to take action in contradiction to permissible action specified in roadside signage.

16. The method of claim 12 further comprising each vehicle having a GPS unit operable to determine whether the vehicle is traveling towards or away from the emergency based at least in part of information included within the emergency alert message identifying a location or area of the emergency.

* * * * *

UNITED STATES PATENT AND TRADEMARK OFFICE

CERTIFICATE OF CORRECTION

PATENT NO. : 8,000,887 B2
APPLICATION NO. : 11/675194
DATED : August 16, 2011
INVENTOR(S) : John F. Nathan et al.

It is certified that error appears in the above-identified patent and that said Letters Patent is hereby corrected as shown below:

Column 4, Lines 58-59, Claim 3:

Delete "communication" and insert -- communicating --.

Column 4, Line 67, Claim 5:

Delete "communication" and insert -- communicating --.

Column 5, Line 5, Claim 7:

After "comprising" delete "the".

Column 5, Line 20, Claim 11:

After "different" delete "instructions".

Column 6, Line 29, Claim 16:

After "in part" delete "of" and insert -- on --.

Signed and Sealed this
Fifteenth Day of November, 2011

David J. Kappos

David J. Kappos
*Director of the United States Patent and Trademark Office*